United States Patent [19]

Gabriel

[11] Patent Number: 4,943,099

[45] Date of Patent: Jul. 24, 1990

[54] TONGS-LIKE CARGO HOOK DEVICE WITH AUTOMATIC LOADING AND UNLOADING CAPABILITY

[76] Inventor: Edwin Z. Gabriel, 91 Mt. Tabor Way, Ocean Grove, N.J. 07756

[21] Appl. No.: 261,940

[22] Filed: Oct. 24, 1988

[51] Int. Cl.[5] ..... B66C 1/38

[52] U.S. Cl. ..... 294/82.32; 294/88; 294/110.1; 294/118

[58] Field of Search ..... 294/82.24, 82.27, 82.3, 294/82.31, 82.32, 82.33, 88, 75, 110.1, 118, 119

[56] References Cited

U.S. PATENT DOCUMENTS

| | | | |
|---|---|---|---|
| 1,507,706 | 9/1924 | Miller et al. | 294/82.32 |
| 4,452,481 | 6/1984 | Williams | 294/118 |
| 4,542,929 | 9/1985 | Possinger | 294/88 |
| 4,717,189 | 1/1988 | Gabriel | 294/82.3 X |

FOREIGN PATENT DOCUMENTS

| | | | |
|---|---|---|---|
| 1007968 | 3/1983 | U.S.S.R. | 294/88 |

*Primary Examiner*—Margaret A. Focarino
*Assistant Examiner*—Dean J. Kramer

[57] ABSTRACT

This is a cable-scooping cargo hook device, pivoted near its center and weighted on top to help force its lower portions to automatically separate upon touchdown on a platform to discharge its load cable. By having the device sit on one of its jaws, the device can be made to avoid rescooping a discharged cable, in its simplest version. Also to assist in discharging its load cable are two inwardly protruding extensions with hammerheads, located above the pivot pin. These hammerheads have magnets of like polarity facing each other to produce a repulsive force and cause the device's jaws to open immediately when the hoist cables slacken, a feature to assist in the jaws straddling and scooping up a load cable. Also an electromagnet to perform the same function as the permanent magnets is described. Then a technique involving additional electromagnets enables the device not only to discharge a loaded cable while suspended, but also to improve its automatic loading ability. In addition to the use of one or more electromagnets for achieving positive load retention, positive load retention techniques are shown which are completely mechanical, requiring no electrical energy source.

11 Claims, 14 Drawing Sheets

FIG. 2
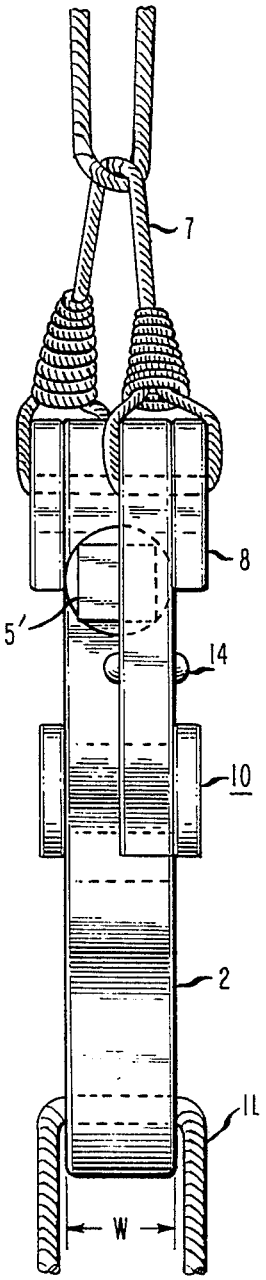
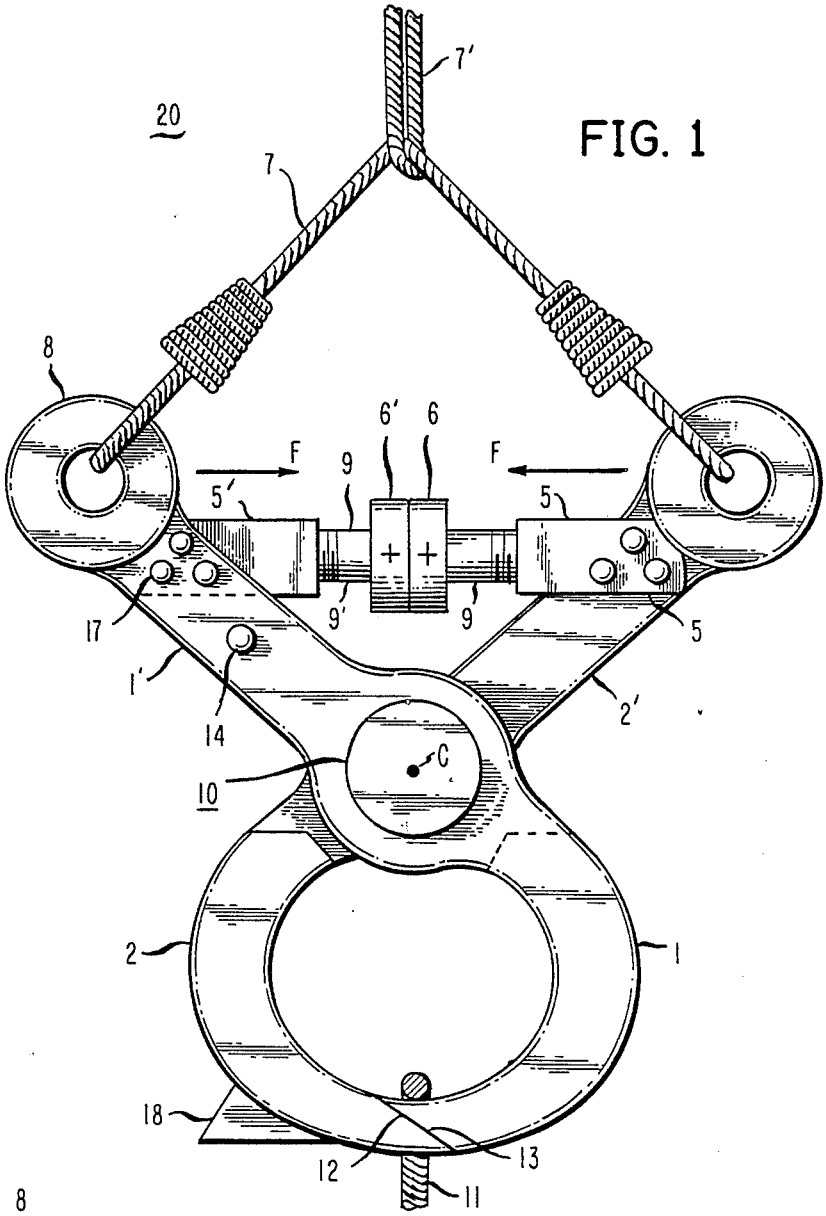
FIG. 1
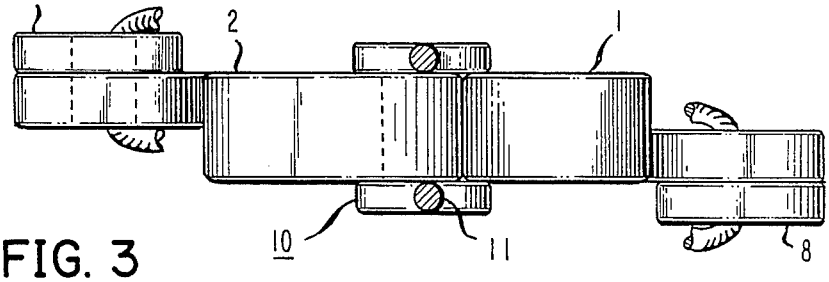
FIG. 3

FIG. 14
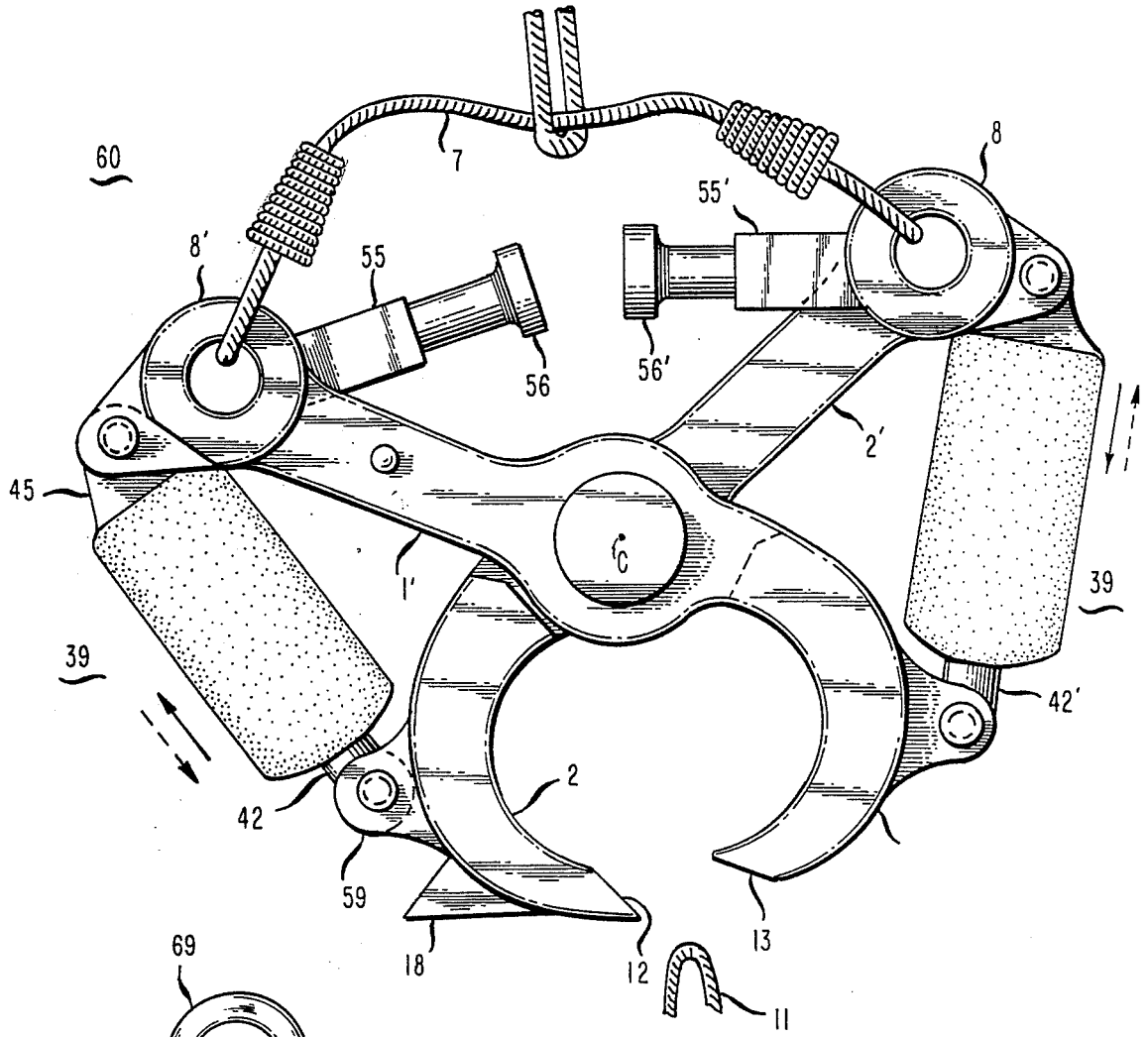
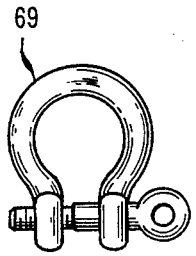
FIG. 15

FIG. 17
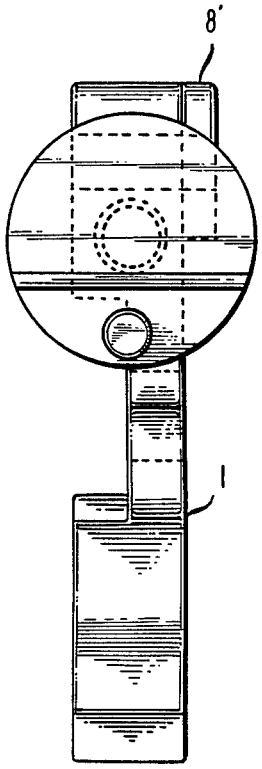
FIG. 16
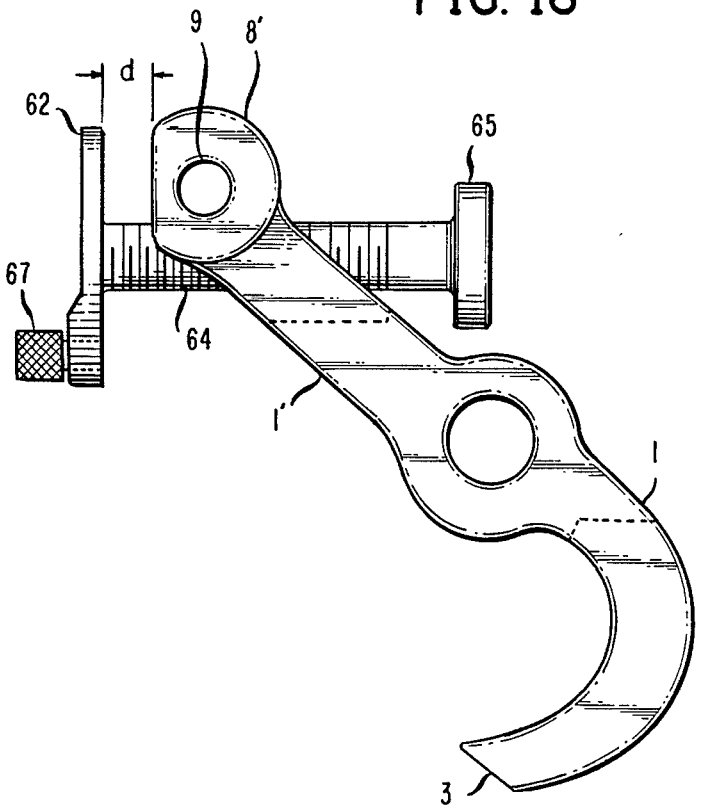
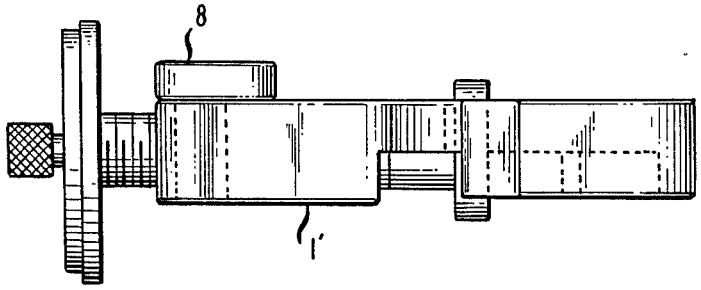
FIG. 18

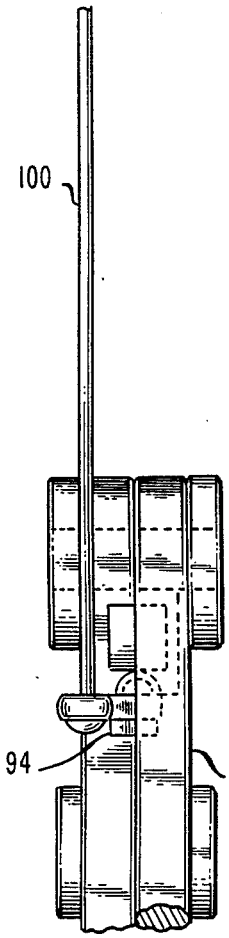
FIG. 20
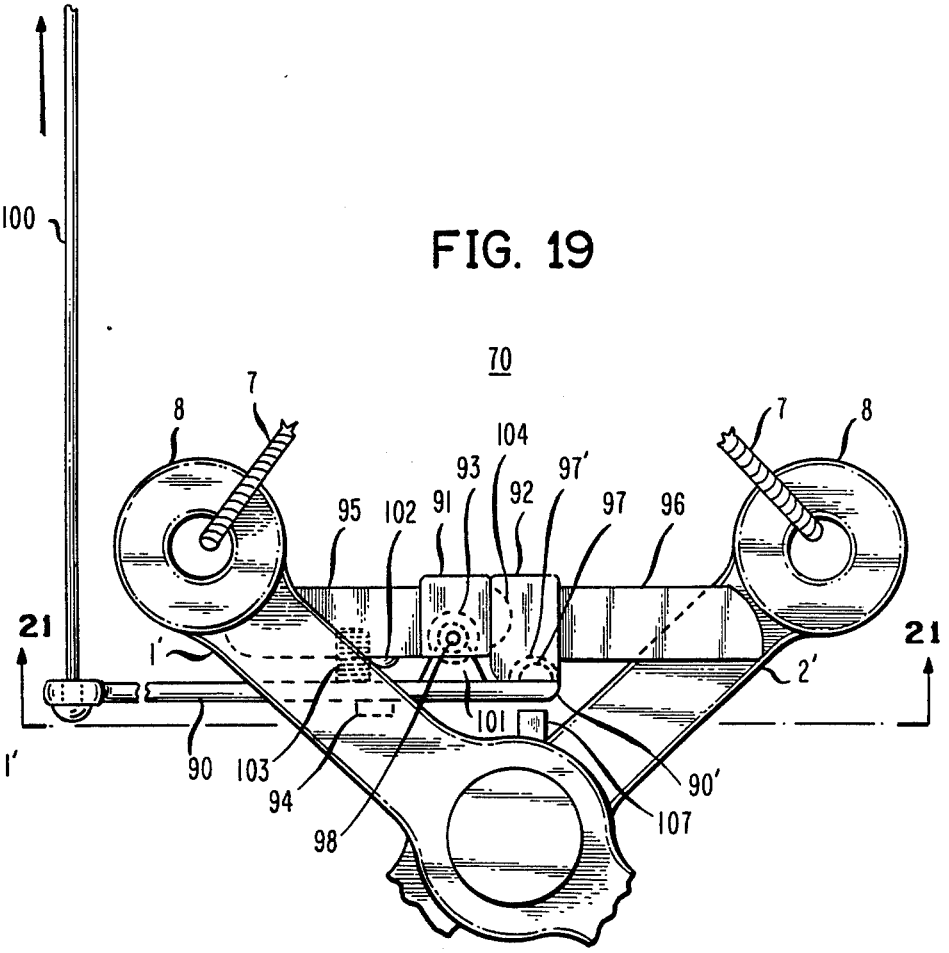
FIG. 19
FIG. 21
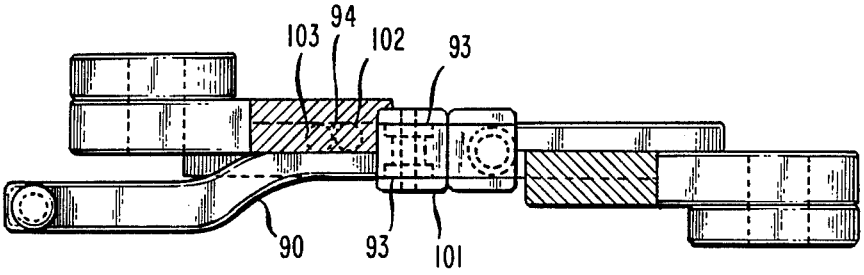

TONGS-LIKE CARGO HOOK DEVICE WITH AUTOMATIC LOADING AND UNLOADING CAPABILITY

BACKGROUND OF THE INVENTION

Previous cargo hooks with automatic cargo unloading capability have been complicated in nature with many moving parts, lacking in automatic loading capability, and loading and unloading of capability with the hook in mid-air.

Other cargo hooks with automatic unloading of the load cable have lacked back-up positive load retention, wherein accidental application of signal to unload suspended cargo has been possible.

Another problem has been ready inspection of the device for imperfections, wear and tear. Then fabrication of the device has been labor intensive, the large number of parts needed to be assembled by a skilled mechanic; thus, maintenance and initial costs of the device have been appreciable.

Breeze-Eastern, Union, New Jersey is America's largest supplier of cargo hooks to the military services. To unload suspended cargo remotely, the application of a signal to a solenoid within the hook device is required from an external switch.

What happens if the voltage fails due to possible injury to the wires connected to the solenoid and electrical continuity is lost?

In one of the inventor's configurations, no voltage application is required, even with back-up position load retention. A cord is provided so that when pulled the load cable is capable of being released. However, the load cable still is not released until the cargo touchdown and the hoist cable slackens.

Automatic 'loading' and unloading of suspended cargo is desirable in ship-off-shore material handling operations, in removal of toxic containers and other toxic waste material in industrial plants, and in removal of radon soil containers. The devices described herein also may be applied to the rescue of personnel from damaged ships and from mountainous regions of a country where a mountain climber may have become disabled. Present cargo hooks do not have automatic 'loading' capability

SUMMARY OF THE INVENTION

The present invention describes an improvement of my previous one, U.S. Pat. No. 4,717,189 and describes a versatile, tongs-like, load-cable automatic loading and unloading device for suspending and transporting cargo and personnel. Several versions are described, with and without electromagnets, and with and without the need for external power. No solenoids are required. Here the electromagnets can perform four functions, 1. for back-up positive load retention capability;
2. to enable remote releasing to load, while in suspension;
3. to urge automatic release of load when making touchdown.
4. to assist in automatically and remotely scooping-up the load cable.

In one version of the device, only mechanical means is used to provide back-up positive load retention. A slender lever, spring, and magnet are used to perform the retention means. No voltage is applied. In all of the techniques, rods with hammerheads are used to help relieve the horizontal stresses on the device's complimentary-shaped mating ends, which support the load cable.

In the simplest technique, without back-up load retention, magnetics are incorporated in each of the two abutting hammerheads, with identical polarities facing each other, so that a repulsion force exists. Such a force is desirable to assist in the device's ability to scoop up a load cable.

In another version, wherein back-up positive load retention is utilized at least two electro-magnets are used, in order to enable the device to unload a load cable, when required, while under load suspension. This feat is accomplished by adding at least one electromagnet, with its one end fastened to an upper portion and its other end fastened to a lower portion, one of the ends being the magnet's plunger. A one-half inch air gap exists in the plunger when the device's lower ends are in contact. When voltage is applied to the magnet's coil, a force is developed wanting to close the gap. In so doing, the device's lower jaws open to allow the load cable to disengage. Assisting in this effort is the electromagnet with the hammerheads. Its voltage is reversed simultaneously, producing a repulsion force between the two hammerheads, urging them to separate, too.

If positive load retention is not required, then in this latter version, the horizontal electromagnet may be replaced by hammerheads with magnets of lik polarity, as in the simplest technique described above.

BRIEF DESCRIPTION OF DRAWINGS

For the purpose of illustrating the invention; the following drawings show forms which are presently preferred. It is understood however that this invention is not necessarily limited to the precise arrangement, instrumentalities and field of utility as therein demonstrated.

FIG. 1 is a front assembly view of a cargo hook device with hammerheads attached to its upper portions to share the horizontal forces imposed on the device's lower contacting ends under suspended load conditions. The hammerheads have magnets of like polarity facing each other.

FIG. 2 is a side view thereof.

FIG. 3 is a bottom view thereof.

FIG. 11 also is a side view thereof.

FIG. 16 is a detailed front view of one-half of the cargo hook device, pivot pin removed, as shown in FIG. 1, except that the fixed horizontal bar is replaced by one that is threaded and greater in length, with a crank wheel attached to its external end. The crank allows the user to crank the hammerhead inward and force the separation of the lower jaws in the event of an emergency.

FIG. 17 is a side view thereof.

FIG. 18 is a bottom view thereof.

FIG. 19 is a front assembly, upper portional view of a mechanically-operated, positive-load-retention technique for the cargo hook device. In this view the hammerheads are making contact with each other.

FIG. 20 is a side view thereof.

FIG. 21 is a bottom view thereof.

FIG. 14 is a front view of the cargo hook, shown in FIG. 13, but with its upper and lower portions separated, when voltage is applied to its electromagnets'exciting coils.

FIG. 15 is a front view of a shackle that could replace the spliced eye and thimble, shown in FIG. 14, supporting the cargo hook.

In FIG. 14 the metal thimble in the eye is not shown.

DESCRIPTION OF A PREFERRED EMBODIMENT

Figure 4:
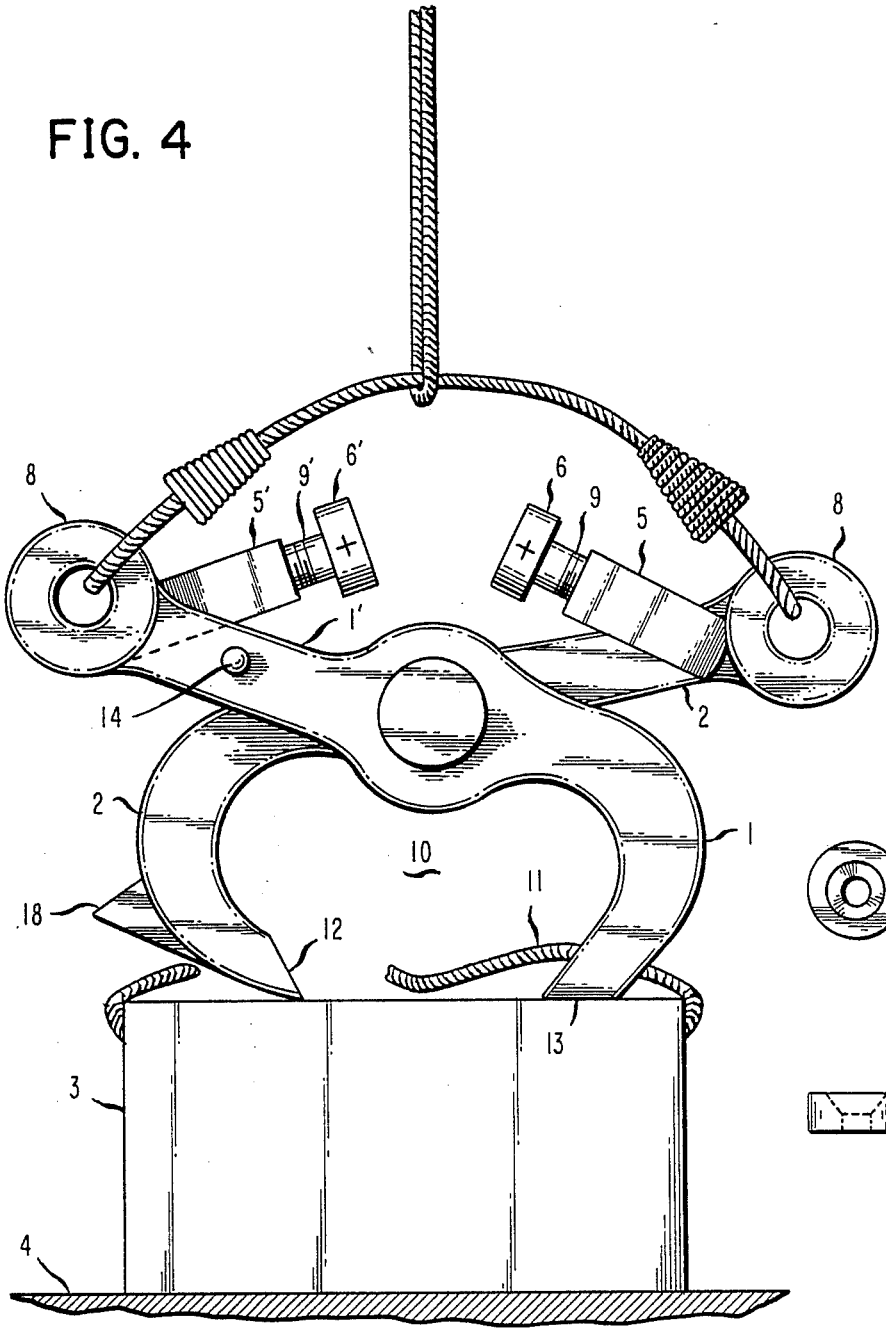
FIG. 4 is a front view of the device with its lower portions separated for discharging the load cable.

Cargo hook device 20 is an improved cable-scooping, hoist-cable coupling device, better able to automatically load than the one described in a previous U.S. Pat. No. 4,717,189.

FIGS. 1 to 3 show a version of device 20 with horizontal bars 5 and 5'with hammerheads 6 and 6' attached to the bars via threaded portions 9 and 9'. Elongated members 1 and 2 pivoted together by pivot pin 10. Their lower portions 1 and 2 overlap at ends 12 and 13, identified more clearly in FIG. 4. Device 20 is better able to automatically load by virtue of complementary shaped ends which overlap with sharp edges, when engaged, without passing each other, side by side, and without dovetailing. Upper portions 1' and 2' have weights 8 of sufficient magnitude to assure that device 20 will separate its jaws upon touchdown. Device 20 is suspended by cables 7 and 7'. Hand-spliced eyes and thimbles 14 are shown; however, a spelter socket of 100% efficiency would be preferred. Also a shackle could be mounted more simply than the spliced eye shown. Horizontal bars 5 and 5' could be mounted to upper portions 2' and 1' by screws, since each bar has a cut-out rear-end, shaped to be supported by the inside surfaces of portions 1' and 2'.

Load cable 11 supports the suspended load or cargo. Threads in horizontal bars 9 and 9' permit adjustment of distance head 6 and 6', so that contact is made when a load is suspended. Once properly adjusted, the threaded portions could be soldered or welded to bars 5 and 5', so they would stay in place. LEDS 17 are shown for the versions shown in FIGS. 6 and 9, when electromagnets with excitation coils are used.

It should be pointed out that heads 6 and 6' have permanent magnets imbedded of the same polarity facing each other, so as to produce a repulsive force when cables 7 and 7' slacken, assisting the separation of lower portions 1 and 2 at touchdown, when either wanting to load or unload cable 11. The strength of the magnets would be determined by experimentation, using certain alnico grades for weaker repulsive forces and neodymium (Ni, Fe, Boron) for higher energy forces. Also the repulsive forces of like poled magnets prevent the faces of hammerheads 6 and 6' from sticking together under high compressive forces.

Figure 5A:
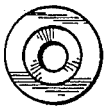
FIG. 5A is an enlarged end view of one hammerhead, showing the head itself being held in place by a Phillips head screw.
Figure 5B:
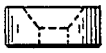
FIG. 5B is a side view thereof.

FIG. 5A shows one way for holding magnet 6' in place, using a phillips head machine screw. If a flat head screw 15 is used, then magnet's (6) hole would be beveled, as shown in FIG. 5B.

FIG. 4 shows device 20 with its lower portions separated and resting on the top surface of cargo 3. Device 20 is not shown to scale relative to cargo 3, resting on surface 4. Bottom end of lower portion 1 could have high impact plastic sides attached to assist in device 20 standing upright upon touchdown. When unloading cable 11, device 20 could be tipped on its portion 2 side, so it would rest on protrusion 18 of high impact plastic, thus avoiding reloading cable 11, upon lifting via hoist cable 7' from cargo 3. As previously explained, magnets at 6 and 6', being of like polarity, assist in keeping lower portions separated until hoist cable 7' is pulled upward and tension is restored in cable 7. Magnets 6 and 6' also prevent the exterior faces of hammerheads from sticking together when abutting under high compressive forces; the presence of the magnets also can enable the jaw ends to disengage automatically with less weight 8 on top.

A SECOND PREFERRED EMBODIMENT

Figure 6:
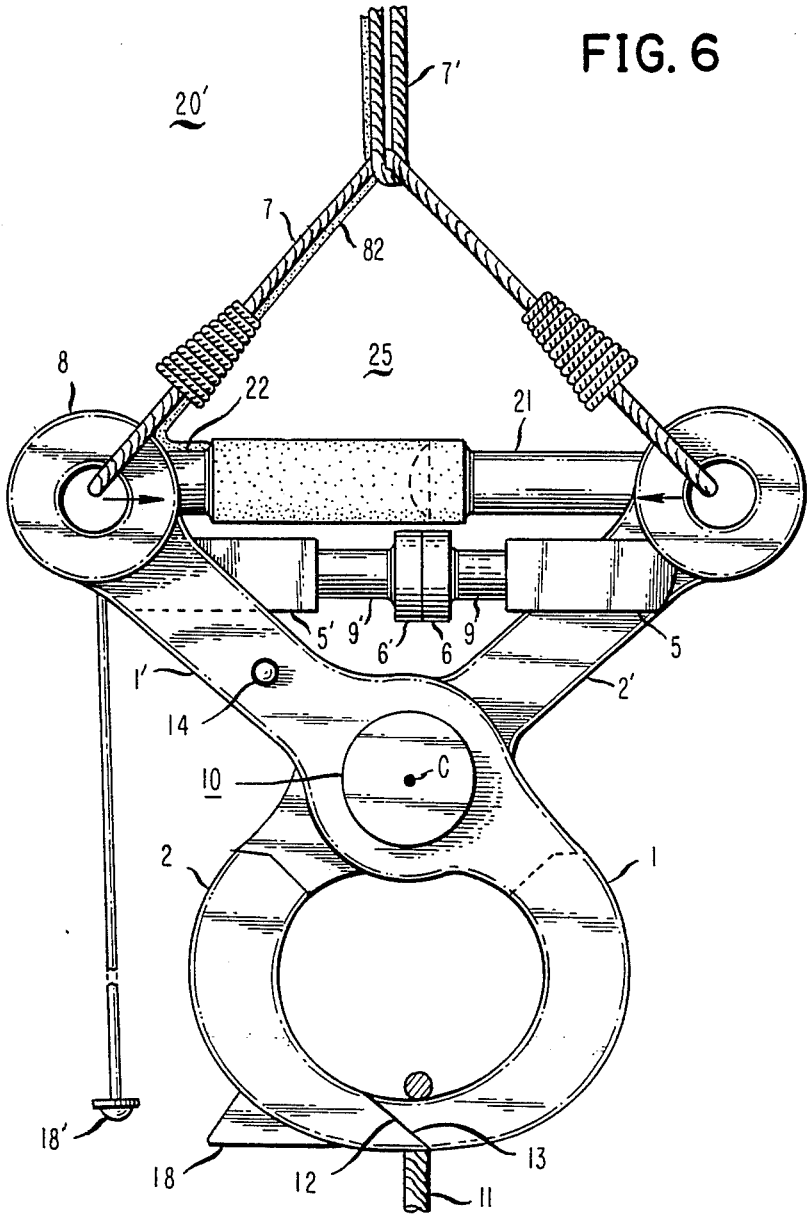
FIG. 6 is a front assembly view of a cargo hook device with both hammerheads and an electromagnet with heads attached to the device's upper portions, the hammerheads to share the horizontal forces imposed on the loaded contacting jaws, the electromagnet to provide positive load retention.

FIG. 6 is identical with FIG. 1 except for the addition of electromagnet 25, in parallel with bars 5 and 5', for positive load retention under all environmental conditions. Bars 21 and 22, supporting electromagnet 25, are attached to upper portions 1' and 2' of device, near location of weights 8.

Figure 8:
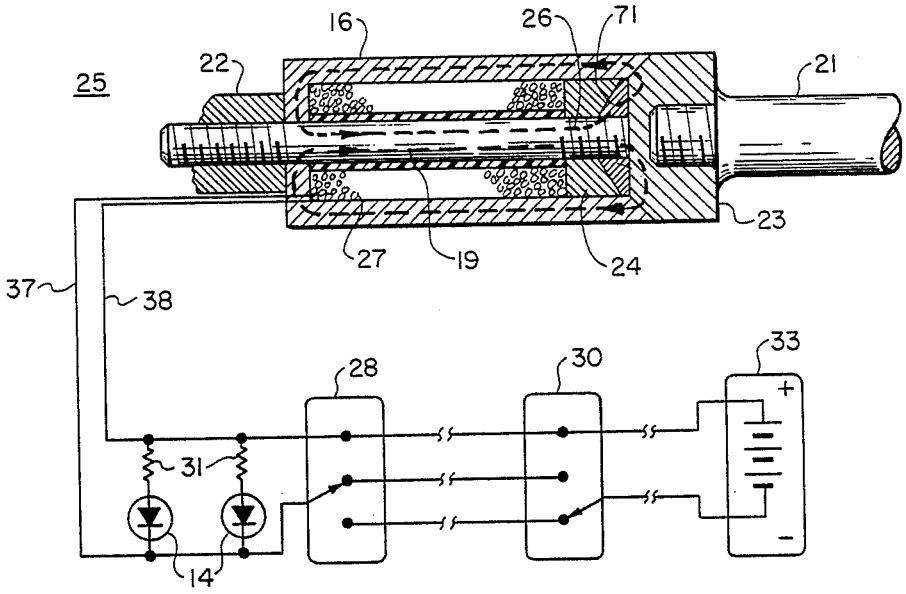
FIG. 8 is a schematic of the external circuitry and a sectional view of the electromagnet shown in FIG. 6. Positive load retention is acquired whe voltage is applied to the excitation coil.

The electromagnet is detailed in FIG. 8, the wiring diagram. It has head 24, attached to electromagnet via core (19) threaded end 26, and has head 23 attached to rod 21 by the threaded end of 21. The opposite end of core 19 is threaded and screwed into bar 22, as shown sectionally. The hammerheads take the brunt of the horizontal structural stresses, while the electromagnet provides positive load retention when voltage is applied. Nut 71 is soft steel.

In this configuraton (SCHEME I) of electromagnet 25, hammerhead 23 is soft steel, and opposing hammerhead 24 which is non-magnetizable steel or metal, such as bronze; core 19 is soft steel, and so is casing 16. Hence, when voltage is applied to coil 27, the magnetic lines or path are as shown in FIG. 8.

Figure 7:
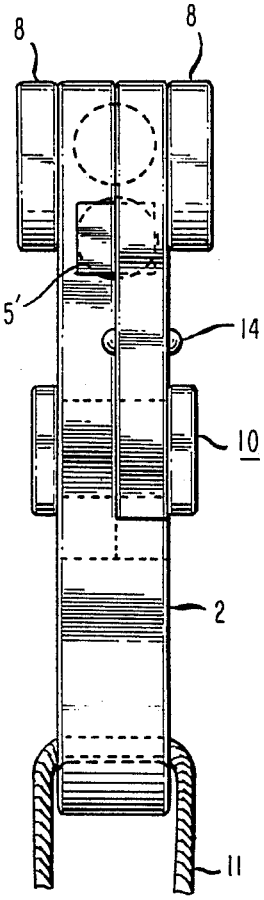
FIG. 7 is a side view thereof.
Figure 9:
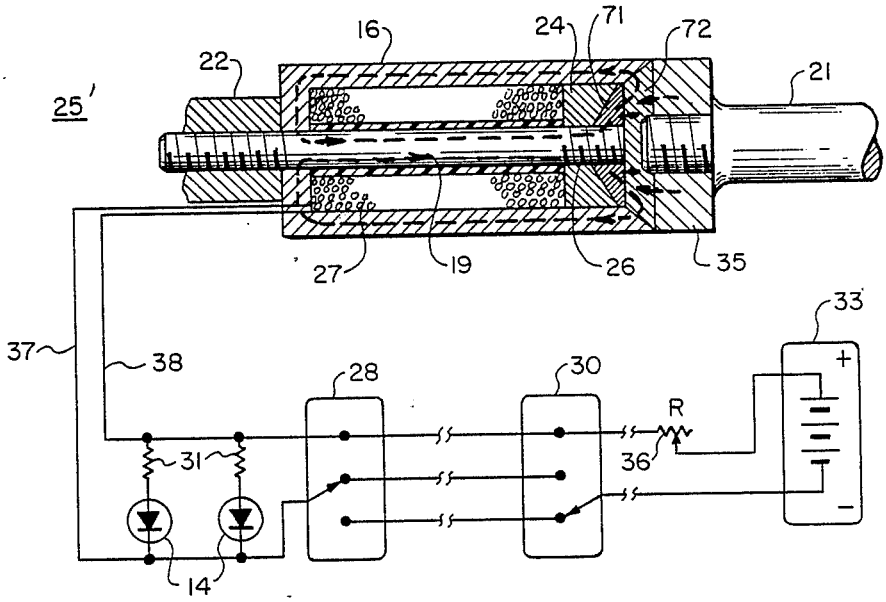
FIG. 9 is another schematic of the circuitry for the electromagnetic component, including the magnetic circuit, for electromagnet shown in FIG. 6. Without voltage applied to the exciting coil, positive load retention is acquired via the permanent magnet in one of the hammerheads.

When positive load retention is desired, either 3-way switch 28 is turned on or 3-way switch 30 is switched, applying voltage from source 33. LEDS, light emitting diodes, 14, one in front and one at rear of device 20' is installed, as shown in FIGS. 6 and 7. This way, during night operations, the operator can observe from the lit LED that the electromagnet is producing positive retention. Resistors 31 limit current flow through LEDS. In Scheme II, essentially the same electromagnet 25, as 25'is used in FIG. 9, as that shown in FIG. 8. To avoid any confusion, FIG. 9 is provided, because of a small but significant design difference. In this configuration hammerhead 35 is a permanent magnet or a permanent magnet is imbedded in a stainless steel casing not shown, the casing providing structural strength to the hammerhead. Rod 21 is stainless steel and resistant to the flow of magetic lines of force. Thus, without excitation applied to coil, 27, the magnetic lines follow the path shown through casing 16 of electromagnet, since cylindrical metal member 24' is also stainless steel and resistant to the flow of magnetic lines of force. Positive load reteention is achieved. With voltage excitation applied to coil 27, the magnetic lines of force produced, following the same path, oppose the magnetic lines emitted by magnet 35, nulling out their presence and allowing device 20' to disengage its jaws and permit load cable 11 to be released. It should be mentioned that potentionmeter 36 is adjusted to provide the right amount of excitation to achieve the desired opposing magnetic force, to cancel out or nullify the magnetic force produced by magnet 35. As in FIG. 8, the same switches 28 and 30 are used, as well as LEDS 14 and resistors 31. Wires 37 and 38 run from electromagnet 25 to switch 28. In FIG. 9, member 72 is soft steel and part of electromagnet casing 16. It has an indentation to accomodate end of screw of rod 21. When voltage from source 33 is applied to coil 27, its polarity and magnitude are such as to just nullify the magnetic line emanating from magnet 35. Nut 71 and disk 71 are both soft steel to permit the smooth flow of magnetic lines of force, enabling core rod 19 to flare to the diameter of magnet 35.

A THIRD PREFERRED EMBODIMENT

Figure 10:
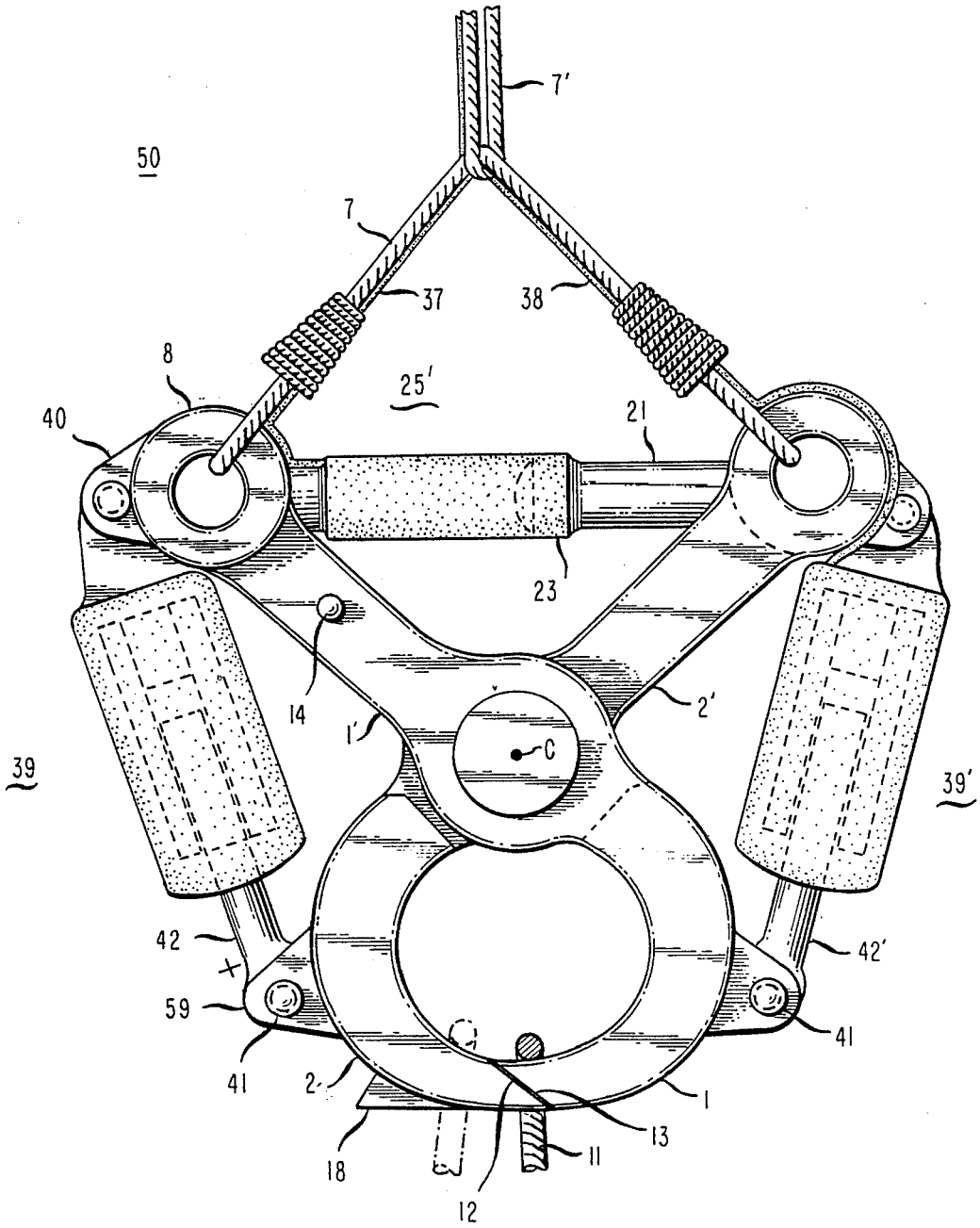
FIG. 10 is a front assembly view of a cargo hook device with three electromagnets, one being shown attached to the device's upper portions, as shown and described for FIG. 6. The other two are shown with their rear ends and with plungers pivoted to the device's upper and lower portions. Their purpose is to assist in urging the device to uncouple, when so desired.

In this configuration of the cargo hook device, FIG. 10, electromagnets 39, 39' are added, one on each side of device 50 to assist weights 8 in opening and separating. Each is pivoted at the top at pivot pin 40 and at the bottom at pivot pin 41. In the position shown, plungers 42 42' are in their extended positions, and each electromagnet's coil is unexcited. When either coil is excited, plunger 42 or 42' is urged to reduce the approximately one-quarter inch air gap. As shown, lower portion 2 is not under vertical stress by load cable 11 suspendng cargo 3; so it is able to separate more easily from lower portion 1, and move upward, permitting cable 11 to roll off the exterior surface of portion 1. Surfaces of portions 1 and 2 are to be smooth and polished Electromagnet 25, FIG. 10, has the configuration of Scheme II, FIG. 9, and its coil, too, is excited.

It should be mentioned that when plunger 42 of 39 moves upward to close the air gap, plunger 42' of 39' moves simultaneously, since upper portion 2' is an extension of lower portion 2. Hence, the separation between ends 12 and 13 of jaws is doubled; from approximately ¼ inch to ½ inch, making it easier for cable 11 to slip off lower end 13. It may be that device 50 will tip slightly on its right side because of the greater torque produced by weight 8 attached to portion 2'. For the above actions to take place, electromagnet 25', FIG. 10, has the configuration of Scheme II, FIG. 9, and its coil too, is excited, permitting electromagnets 39, 39' to function as described. Should hoist cable 11 be in the position shown in dashed lines, then plunger 42 of electromagnet 39 on the right side will move inward and upward first, since now lower portion 1 will not be under stress by load cable 11. It should be mentioned that when plunger 42', on the left side moves inward, device 50 may tip over slightly on its right side. Cable 11 can still roll down the inside exterior surface of lower Portion 1, and be released from device 50. In FIG. 10, electromagnet 39 design would be the same as that shown in FIG. 12. It could be activated remotely either from the ground or from above, as from the cockpit of vertical lift aircraft.

Figure 11:
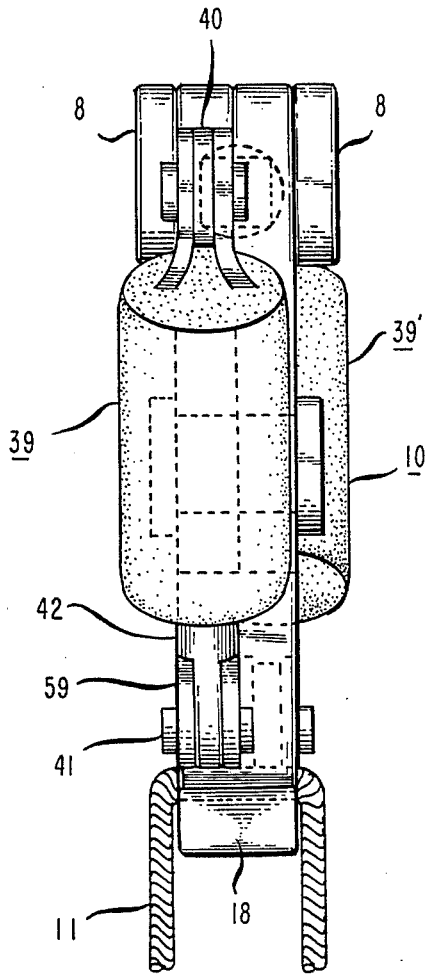
FIG. 11 is a side view thereof.
Figure 12:
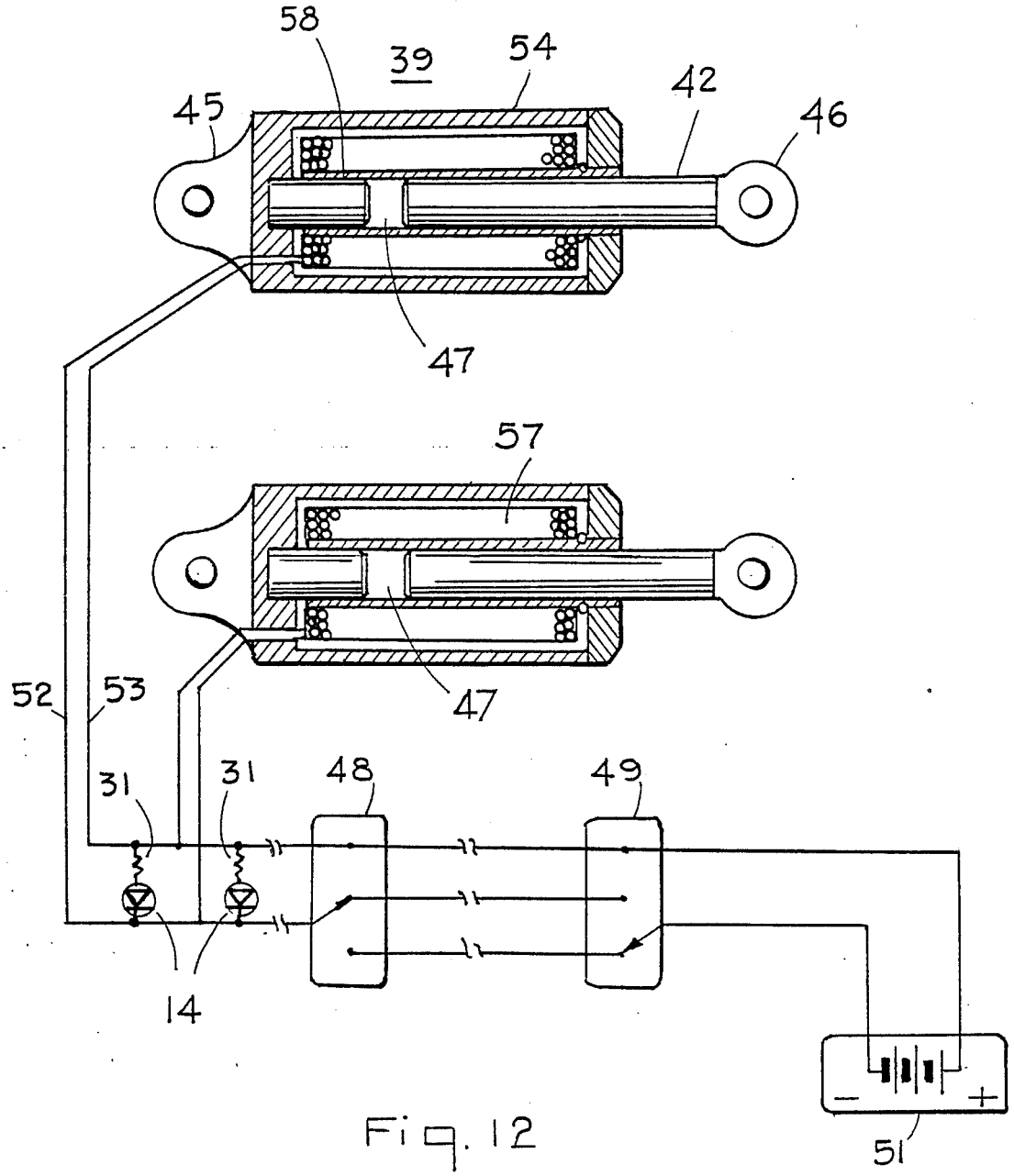
FIG. 12 shows the external circuitry and sectional views of the two electromagnets with plungers.

A side view of device 50 is shown in FIG. 11. The hoist cables 7 and 7'have been omitted from this view to reduce complexity. The design of electromagnets 39, 39' would be similar to that of 25, FIGS. 8 and 9, except now the iron cores 42, 42' move and the hammerheads are not required. Their interior configuration is shown in FIG. 12, including its exterior wiring and switches. The configuration of wiring for electromagnet 25, shown in FIG. 10, would be identical to that shown in FIG. 9. In FIG. 12, although two electromagnet excitation coils are shown wired in parallel, all three electromagnets shown in FIG. 10 could be wired in parallel, reducing the number of switches required and improving reliability.

Figure 13:
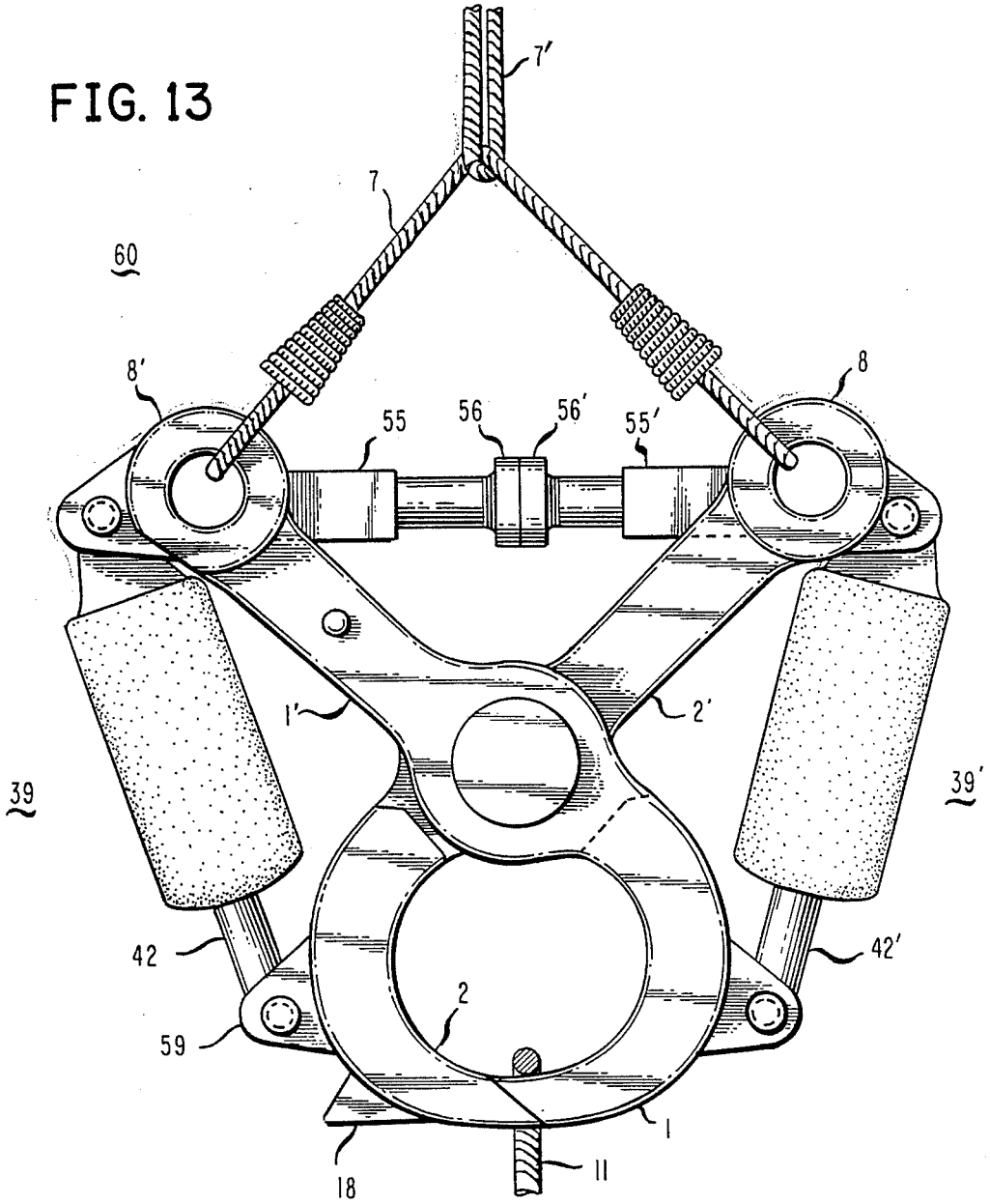
FIG. 13 is a front assembly view of a cargo hook device identical with that of FIG. 10 except that its upper horizontal electromagnet is replaced by horizontal bars with hammerheads.

The device 60 shown in FIG. 13 is identiacl with device 50, FIG. 10, except that electromagnet 25 is replaced by hammerheads. As in FIG. 1, hammerheads 56 and 56' have permanent magnets imbedded therein with like polarities facing each other to promote repulsion and urge the separation of lower ends 12 and 13 both at touchdown and under suspended load conditions. In this configuration of device 60 the horizontal components of tension in hoist cable 7 keeps ends 12 and 13 together and prevent load cable 11 from disengagement. As in device 50, when the coils of electromagnets 38, 39' are excited, urging plungers 42, 42' to recede into casing 54, lower ends 12 and 13 of device 60 separate, even under load suspension conditions. Hammerheads 56 and 56', supported by horizontal bars 55 and 55', also have permanent magnets imbedded therein with their exterior surfaces, facing each other, of like polarity to promote repulsion.

FIG. 11 is also the side view of FIG. 13.

To enable one to visualize how device 60 would appear when plungers 42, 42' are retracted fully into casing 54 by magnetic force, FIG. 14 is provided. When plunger 42 is retracted, plunger 42'must follow; in so doing device 60 may tip slightly on its left side, as shown, enabling load cable 11 to be released from lower portion 1 with greater ease. To avoid any of 39's interference with weight 8' and upper portion 1', a small portion from their left sides are removed. Also a small portion from the upper right side of casing 54 may be removed, though not shown. To reduce the amount of material to be removed from both 39 and upper portion 1', lower bracket 59, protruding from portion 2, may be extended along with its hole. If interference did occur, plunger 42 would not retract as much when coil 57 is excited. No harm to device 60 would occur. An equivalent removal of material from weight 8 and upper portion 2' may be necessary from the upper right side of device 60 to avoid any 39' interference. Elongated lower portions 2 and 1 would move in the directions indicated by the arrows alongside components 39 and 39'. The movement could be in the direction of either the solid or the dashed line arrows.

Figure 14A:
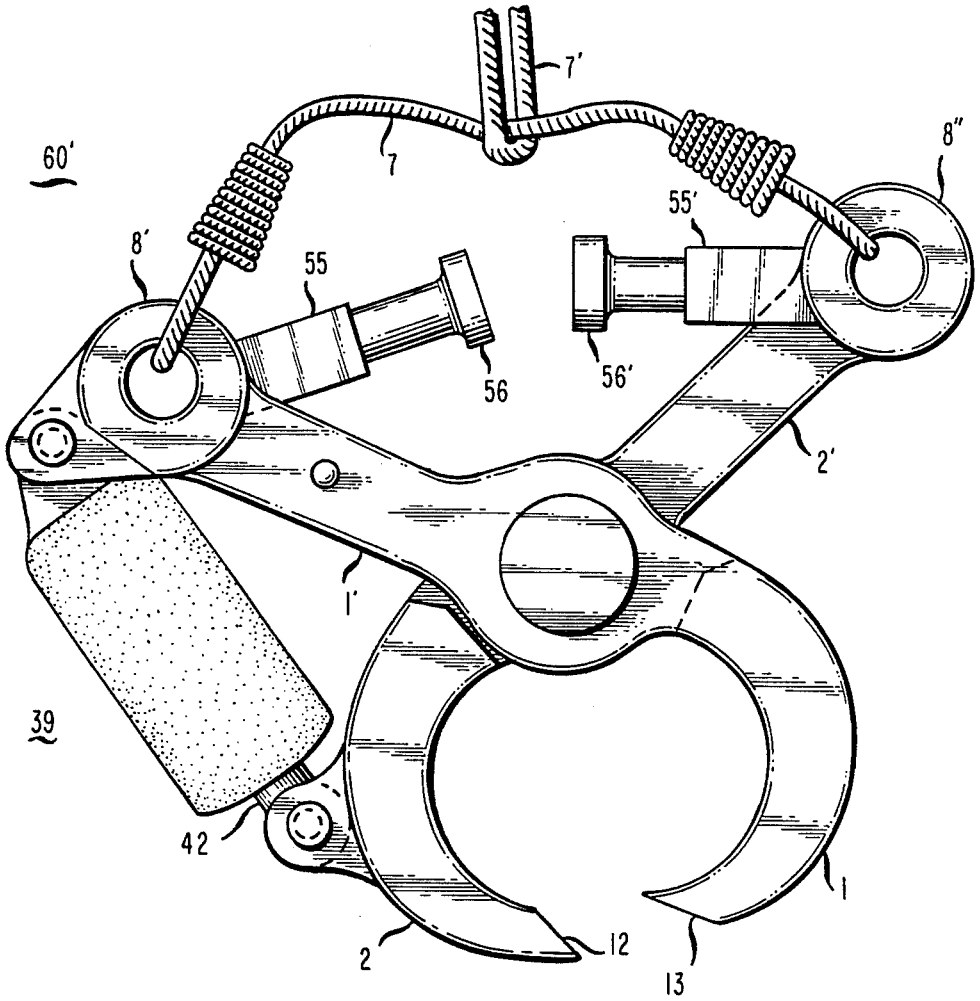
FIG. 14A is identical to hook, FIG. 14, except with a single electromagnet.

For light-weight suspended loads, cargo hook device 60 may have just a single electromagnet 39. Then when coil 57, FIG. 12, is excited, plunger 42 would be urged to reduce the air gap in 39 to zero. In FIG. 14 with two electromagnets excited, the separation between device 60's lower ends 12 and 13 would be a function of the sum of the air gaps in both components 39 and 39'. Then for a single component 39, weight 8 on the right side would be increased in thickness to compensate for the additional weight of 39 added to the left side of device 60. FIG. 14A shows device 60 as 60', with only electromagnet 39, having air gap of ½ inch instead of ¼ inch.

MECHANICAL TECHNIQUE FOR DISCHARGING SUSPENDED LOADS

Figure 24:
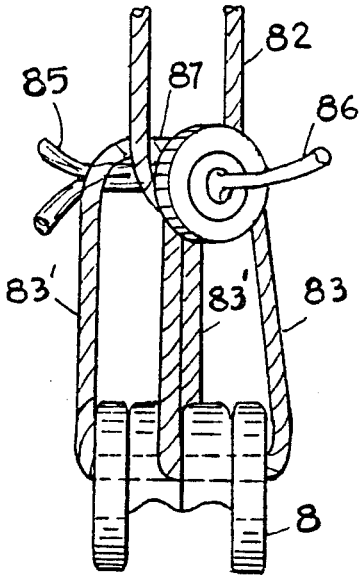
FIG. 24 is a side view thereof.
Figure 23:
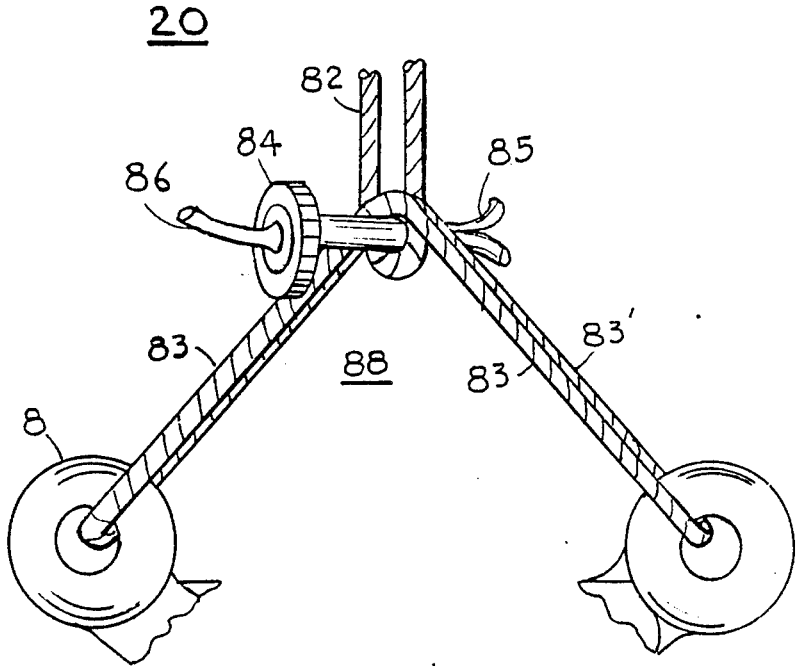
FIG. 23 is a front assembly view of the upper portions of the cargo hook device shown in FIG. 1, showing a removable pin holding together a hoist cable from above and an endless cable between the holes of the upper portions, so a load can be suspended from the device until the pin is manually removed.

In situations wherein a helicopter suspended load must be dropped instantly because the helicopter cannot continue flying with the load, an inexpensive technique for releasing the hoist cable is illustrated in FIGS. 23 and 24. To explain, when hoist cable 82 is released by pulling on cable 86 to remove pin from cable 82, device 20 is allowed to fall with load. For this relatively inexpensive device 20 and light loads, the method illustrated would be appropriate. In this technique, enlarged cotter pin with disk 84 is inserted under cable 83 and over the lower loop of cable 82. Loop 82 lies between front and rear loops 83 and 83', which are shown as one continuous cable. Loops 83 and 83' may be separated by space bar 87, as shown in FIG. 24. Cotter pin 88 would have to withstand the stresses imposed upon it by the load. Pin 88 has a springy rear 85 spread apart, as shown, to prevent the pin from working itself free from the hoist cables. To assist in easier removal of pin from cables 82 and 83, polished metal thimbles are adhered by adhesive to the underneath of cables 83 and 83' and over cable 82 at the points of contact with pin. Disk 84 enables one to hold pin and insert it where shown. Also surface of pin should be polished or easier removal. The pin shank should be stainless steel but bent end 85 could be some other noncorrosible springy material. The thimbles are not shown to avoid undo complication to FIGS. 23 and 24.

RELEASE OF LOAD CABLE MECHANICALLY

Description of a Mechanical Technique for releasing the load cable while in mid air is provided for some emergency situations.

There may be instances when the load cable 11 must be released, when electromagnets shown in FIGS. 16 and 18 are unable to do so, such as when the excitation voltage is nonexistent. Then a mechanical means, such as a crank and screw and rod combination may be used to enable separation of lower portions 1 and 2, FIG. 1. Just one elongated member 1 of device 20 is shown, because only one crank 62 and screw 64, FIG. 16, is needed to perform the separation. Crank 62 is fitted with knob 67, to assist user in rotating 62 inward a total distance of "d", to separate lower portions 1 and 2, FIG. 1. Knob 67 is free to turn about an axle protruding from crank 62. To return hammerhead 65 to its original position, as shown in FIG. 16, crank 62 is rotated in the reverse direction. Weight 8' has its exterior portion cut off, as shown, to enable hammerhead 65 to move inward a distance "d".

It should be added that a motor could be coupled to the outward end of threaded rod 64 to enable the rotation to be performed by remote control. A coupling sleeve to couple motor shaft to an extension of rods 64 would be added. The sleeve would have an elongated slot for a protrusion on the outward surface of rod 64 to extend through. The slot would permit translational movement of rod 64, with the motor fixed to a bracket, supported on upper portion 1'. FIGS. 17 and 18 are the side and bottom views of front view, respectively.

REMOTE CONTROL MECHANICAL POSITIVE LOAD RETENTION

This coupling device 70 represents another technique for securing and achieving position retention, one that is completely mechanical. Here rods 5 and 5' with hammerheads 6, 6' FIG. I are replaced by rods 95 and 96 with rectangular hammerheads 91, 92, in FIG. 19. Since only the upper portion of the device is involved, FIG. 19 shows only the upper half of the device, designated as 70.

Positive retention is achieved through a spring-loaded lever 90 with hemisphere 97 at one end, with a crook half way in between, and a cord 100 attached to its other end. Hemisphere 97 fits into recess 97' when coupling device 70 is engaged. Lever 90 is held in horizontal position by both coil springs 93, compression spring 103 and by stop 94, upon which lever 90 rests. Thus, hammerheads 91, 92 cannot separate. When it is desired to decouple device 70, cord 100 is pulled upward, causing hemisphere 97 to dislodge from recess 97', allowing hammerheads to separate. They would separate by the force of gravity due to weights 8. Lever 90 is restricted from being pulled up any higher than stop 102. When the pull on cord 100 is slackened, lever 90 is restored to its horizontal position by coil spring 103 and by stop 94, fastened to 1', also shown in side view, FIG. 20.

To further explain, when device 70 is lifted by hoist cable 7, hammerheads 91 and 92 come together; in so doing, hemisphere 97 automatically engages recess 97'. Now hammerheads 91 and 92 are abutted and in place. They will not separate under any environmental conditions. Only by pulling on cord 100 can they separate. Thus, load cable 11 is secure on surface of overlapping ends, shown in FIGS. 1 and 2. To assist in a perfect alignment of heads 91 and 92, when coming together, a spherical projection 97 and 90 and a spherical recess 97'in 92 may be provided. Projection 97 and recess 97' are shown in dashed lines in side view, FIG. 20, and in bottom view, FIG. 21.

To summarize, to disengage hammerheads 91 and 92, cord 100 is pulled upward at one end, causing the other end of lever 90 to move downward, thus releasing its hemisphere 97 from its recess 97'. If the suspended cargo is resting on a rigid surface and both load and hoist cables are slack, device 70 still would not decouple, unless cord 100 has first been pulled upward to permit the disengagement. It should be added that the width of the contacting ends of device's lower portions 1 and 2 is W, FIG. 2, so that device 70 can stand upright when in contact with a surface below. When cord 100 is slackened, compression spring 103 urges hemisphere 97 to make contact with recess 97', FIG. 19. When cord 100 is pulled up in direction of arrow, hemisphere 97 is unseated and clears bottom surface of hammerhead 92, allowing the two upper portions 1' and 2' to separage from each other.

For a strong coil spring 103, the slackening of cables 7 and the lifting of cord 100 should be performed in synchronism. For a light coil spring 103, cord 100 may be lifted any time after cables 7 have slackened.

Compression spring 103 has one end recessed in a cylindrical cavity, with its end fastened to the cavity, located underside of bar 95.

Thus, instead of a solenoid or a combination of a magnet and an electromagnet, a strictly mechanical means has been provided for acquiring positive load retention for suspended cargo.

Figure 22:
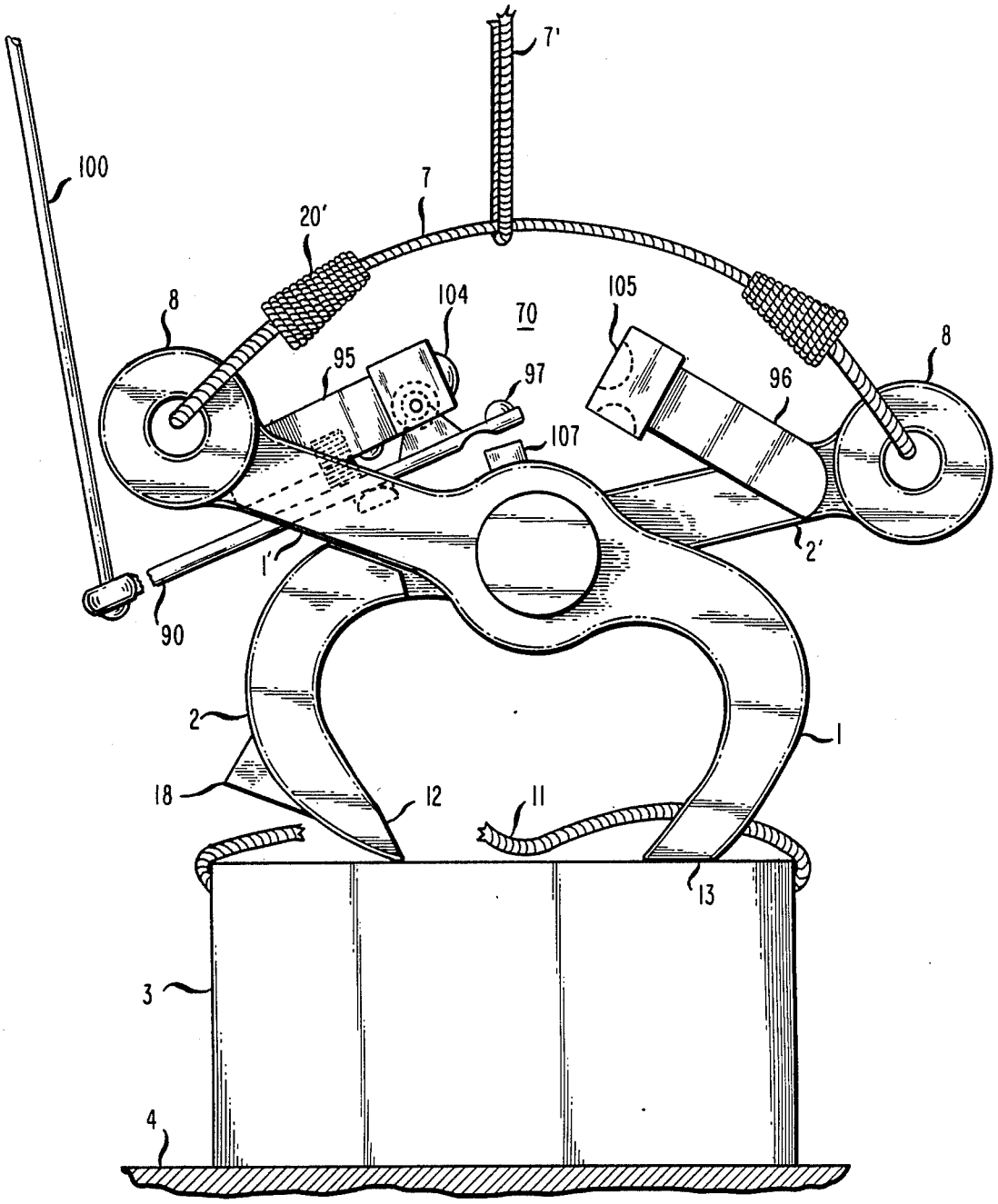
FIG. 22 is a front assembly view of the cargo hook device with its upper and lower portions separated and the load cable discharged. In this technique, positive load retention is achieved entirely mechanically with the aid of a pivoted lever and an attached card. When the cord is pulled upward by a crane operator or by helicopter pilot in a cockpit, the lever decouples the hook.

FIG. 22 shows coupling device 70 disengaged, with lever 90 and hammerheads 91 and 92 separated from each other. At this point, it should be added that the shapes of hemisphere 97 and recess 97' may be altered to ensure that the two shapes will not accidentally dislodge. This can be achieved by having the rear side of 97 square and the front side of recess 97' with edges smoothed over, thus ensuring positive engagement of protrusion 97 with recess 97' until cord 100 is pulled.

PROCEDURE FOR DISENGAGING LOAD CABLE

This mechanical hook retention scheme suggests use of a magnet 107 to enable load cable to disengage once the hoist cable slackens.

The suggested position of Alnico magnet on hub on non-magnetically attractable stainless steel is shown in FIG. 19.

Cord 100, FIG. 19, is pulled upward just prior to load 3 coming to rest on a rigid platform 4. When cord is pulled, underside of inward end of pivoted lever makes contact with Alnico or equivalent magnet 107 remains there by magnetic attraction, since lever 90 is of ferrous metal having low resistance to the passage of magnetic lines. When load 3 does come to rest, cable 7 is slackened allowing jaws 1 and 2 to separate. Elongated halves 1' and 2' of device are made either of nonferrous, nonmagnetic material or of non-magnetically attractable stainless steel, to enable the strength of the magnetic lines of force to be retained. The retention of the underside of lever's inward end to magnet 107 may endure only a few seconds, sufficiently long so that lever 90's eventual position would be horizontal as shown in FIG. 19, while jaws 1 and 2 of device are spread apart, as shown in FIG. 72.

Magnet 107 is necessary to allow jaws 1 and 2 to open and discharge load cable 11, FIG. 22. Jarring of device 70, caused by its impact on a rigid surface, would assist the end 90' of lever 90 to detach from 107, if magnets's strength has a properly designed intensity.

I claim:

1. A cargo hook device for quickly scooping up and releasing suspended cargo remotely and automatically, comprising a tongs-like part A, having two elongated members, pivoted near their mid-section by a central pivot pin, and having hammerheads with exterior faces, for use with a load cable and hoist cables, each cable being adapted for attachment to said part A, said members having upper and lower portions, each said upper portions having a weight for automatically separating said portions upon touchdown of said cargo, said lower portions having complementary-shaped, sharp-edged beveled jaw ends having upper and lower surfaces, which close against each other end-to-end to form a smooth continuous contour between said engaging ends when supporting said load cable, because of the tension on said hoist cable; said upper portions having inside surfaces with a primary rod fastened horizontally to each of said inside surfaces, with said device in an upright position, and each rod having said hammerhead at one end and each said hammerhead extending inward and containing a permanent magnet, said magnet's exterior having the same polarity as the polarity of the magnet contained in the opposing hammerhead, so that the two magnets when coming together tend to repel with a force of sufficient intensity to assist in said ends separating from each other the moment said hoist cables slacken upon touchdown of said cargo; said magnets enabling said ends to disengage automatically with less magnitude of said weight, thereby reducing said device's weight; said magnets also preventing said exterior faces when abutting from sticking together and hindering the separation of said jaw ends due to high compressive forces; said beveled ends, one beveled at its lower and the other at its upper surface, shaped so as to automatically scoop up a load cable lying between said ends, when said device is lifted.

2. A cargo hook device in accordance with claim 1 and wherein positive back-up load retention is provided as added safety in maintaining said jaw ends in contact under all environmental conditions, said means being the addition of two secondary rods, each one in parallel with one said primary rod, one of said secondary rods having a soft steel hammerhead and an integrated electromagnet with an exciting coil, the other of said rods having a hammerhead of permanent magnetic material, thereby achieving positive retention of said suspend cargo by magnetic attraction of one said hammerhead for the other said hammerhead, with said electromagnet de-engerized; whereby when said electromagnet is energized, the lines of magnet force produced forming a magnetic field which would oppose the magnetic field produced by said magnetic material, the polarity of each field being of the same strength and intensity and of the same polarity, thus by repulsion allowing said coupling device to uncouple and free said load cable from said device when said cargo makes contact with a rigid surface below or whenever said hoistg cable slackens; thus, when supporting heavy cargo, each said primary rod and attached hammerhead taking the brunt of the horizontal structural stresses, and said secondary rods, each with a hammerhead, providingr secure positive load retention of said load cable by maintaining magnetic attraction of one hammerhead for the other hammerhead.

3. A device in accordance with claim 2 and wherein said electromagnet having a soft steel core rod, threaded at its end and a soft steel tapered nut screwed to said end; thus, the end of said rod being flared to a larger diameter, approaching the diameter of said hammerhead, thereby, when energized, permitting a smoother flow of magnetic lines to oppose the magnetic lines of the magnetic field of said permanent magnetic material, thus producing a repulsive force for uncoupling said device and permitting said load cable to be released when said cargo makes contact with a surface below.

4. A cargo hook device in accordance with claim 1, and wherein positive back-up load retention means is provided as an added safety precaution for maintaining said ends in contact under all environment conditions, said means being the addition of two secondary rods, each one in parallel with one said primary rod, one of said secondary rods having an integrated electromagnet with an exciting coil and a magentizable head and a magnetizable core rod, and the other said rod having a soft-steel receiving hammerhead, one said hammerhead capable of butting against the other said hammerhead when said decive supports said load, wherein said magnet is energized by applying voltage to said coil to produce lines of force that pass through said soft-steel hammerhead, for obtaining the required tractive force for adhering said magnetizable core rod against said receiving hammerhead, for producing positive and secure retention of said load cable, until said electromagnet is de-energized; the primary load retention means being said tension on said hoist cable when said device suprots said cargo, because of said weight on each upper portion, should said electromagnet become accidentally de-energized; the primary rods and hammerheads taking the brunt of the horizontal sturctural stresses, while the secondary rods and integrated electromagnet providing secure load retention, when said electromagnet energized.

5. A cargo hook device in accordance with claim 1, wherein each lower portion has an underneath side and wherein a supporting structural piece is added to said underneath side of one of said lower portions to enable said device to sit upright on said underneath side of each said lower portion when making contact on a supporting surface; and to avoid reloading of said cable when said device is lifted again, by rotating said device, about said piece as a pivot, prior to lifting.

6. A cargo hook device in accordance with claim 1, and wherein two electromagnets, parts B and C, are added to said device each part having an air gap G, an excitation coil and each said parts having two ends, and the exterior surface of each lower and upper portions having a protrusion, each said part having one end pivoted to the exterior of an upper portion and having its other end, a plunger end with a hole, pivoted to said protrusion of a lower portion, both pivoted ends being in the same side of said device, each said excitation coil of parts B and C being connectged in parallel with the other; when said coil is electrically excited, enabling the separation of the complementary-shaped ends of said lower portions, said separation being double the magnitude produced by a single electromagnet with said air gap G, and the magnetic force producing the separation being double the force exerted by a single excited coil, thus allowing said load cable to be more readily released from said device, each said permanent magnet assisting in said separation, each said pivoted ends enabling slight rotational motion to occur in said electromagnet's casing due to said upper portions' angular motion about said central pivot pin, when loading a cable.

7. A cargo hook device for quickly scooping up and releasing suspended cargo remotely, comprising a tongs-like part A, having two elongated members, pivoted near their midsection by a central pivot pin and having hammerheads with exterior faces, for use with hoist cables and a load cable, each cable being adapted for attachment to part A, said members having upper and lower portions and jaws, each said upper and lower portions having an exterior surface, each said upper portions having a weight for automatically separating said portions upon touchdown of said cargo; said lower portions haivng complementary-shaped ends, having sharp-edged beveled ends which close against each other end-to-end to form a smooth continuous contour between said engaging ends when supporting said cargo via said load cable, because of the tension on said hoist cables; said upper portions having inside surfaces with a primary rod fastened horizontally to each of said inside surfaces, with said device in upright position, and each rod having a hammerhead at one end, and each said hammerhead extending inward, and wherein at least one electromagnet, part B, having two ends and an excitation coil, is added to said device, one of szaid ends of part B being pivoted to the exterior surface of one of said upper portions and the other of said ends being pivoted to the exterior surface of one of said lower portions, both pivots being on the same side of said device, one of said two ends of said part B being plunger whose end has provision for being pivoted to said lower exterior surface, and said plunger having an air gap G when extended; said part B, when electrically excited, enabling the separation of said lower portions by said plunger retracting distance G, so that when said device suspends a light load, said load cable can be released from said device, overcoming said tension on said hoist cables.

8. A cargo hook device in accordance with claim 7, and wherein two electromagnets, parts B and C, each having an air gap G and each having two ends, are added to said device; said part C having one end pivoted to the exterior of the other of said upper portions and having the other of said ends pivoted to the other exterior surface of the other of said lower portions, both pivots of each said part B and C being on the same side of said device, one of said two ends of said part C being the plunger, the excitation coils of said parts B and C being connected in parallel, said coils, when electrically excited, enabling the separation of the complementary-shaped ends of said lower portions by each said plunger retracting distance G, said separation being double the magnitude produced by said single part B electromagnet along, and also said magnetic force producing the separation being double the force exerted by a single excited coil, thus allowing said load cable to release double the load capacity of a single said electromagnet with said air gap G.

9. A cargo hook device for quickly scooping up and releasing suspended cargo remotely comprising a tongs-like part A, having two elongated members, pivoted near their center by a pivot pin for use with a hoist and a load cable, each cable being adapted for attachment to said part A, said members having upper and lower portions, each said upper portions having a weight for automatically separating said portions upon touchdown of said cargo, said lower portions having complementary-shaped ends which engage when supporting said load cable; said upper portions having inside and exterior surfaces with a primary rod fastened horizontally to each of said inside surfaces, and each rod having a hammerhead at one end, each said hammerhead extending inward, and wherein one said primary rod being screwed into one of said inside surfaces of said upper portion and having an extension protruding from the exterior of said upper portion, said protrusion having a crank with a handle attached, said handle to enable a user to crank said handle for moving said hammerhead inward when said cargo is suspended from siad device, thus causing said ends of said lower portions to separate and release said load cable during occasions when said cargo must be released, even when in mid-air; said hammerheads when abutting also sharing the structural stresses imposed on said ends when supporting said cargo.

10. A cargo hook device for quickly scooping up and releasing suspended cargo remotely, comprising a tongs-like part A, having two elongated members pivoted near their center by a pivot pin for use with a hoist and a load cable, each being adapted for attachment to said part A, said members having upper and lower portions, each said upper portions having a weight for automatically separating said portions upon touchdown of said cargo, said lower portions having complementary-shaped ends which engage when supporting said cable; said upper portions having inside and exterior surfaces with a primary rod fastened horizontally to each of said inside surfaces, and each rod having a hammerhead at one end extending inward; and wherein a hoist mechanism supports said device and wherein a pivoted, spring-loaded, off-setted lever is added to one of said upper portions, said lever having inward and outward portions, and wherein said pivot pin has a hub; said lever being pivoted at one of said hammerheads, to prevent said hammerheads from separating from each other when each said hammerhead is abutting against the other; the outward portion portion of said lever having a cord attached to be pulled upward by the operator of said hoist mechanism for decoupling and allowing said lower portions to separate and permit release of said load cable, said lever normally being held in position by a compression spring on top and a stop means underneath, said cord being pulled just prior to said cargo making contact with rigid surface below; said upper portion of said hub having a magnet attached thereto sufficient strength to keep said inward portion of said lever in an unlatched position momentarily by being attracted to said magnet, until said hammerheads, including said upper and lower portions, are separated, allowing said load cable to be released; once separated, said weight on each said upepr portions keeping said portions apart; said hub being magnetizable to enable said magnet to be effective in momentarily keeping said lever in an unlatched position.

11. A cargo hook device for quickly scooping up and releasing suspended cargo remotely, comprising a tongs-like part A, having two elongated members, pivoted near their center by a pivot pin for use with a hoist and a load cable, each cable being adapted for attachment to said part A, said members having upper and lower portions, each said upper portions having a weight for automatically separating said portions upon touchdown of said cargo, said lower portions having complementary-shaped ends which engage when supporting said load cable; said upper portions having inside surfaces with a rod fastened horizontally to each of said inside surfaces, and each rod having a hammerhead at one end extending inward; wherein a pin with an attached heavy cord is provided, and wherein each of said upper portions has a hole and an endless cable looping from one hole to the other forming parallel lines, and wherein a hoist cable from a hoist forms a loop falling between said parallel lines, said pin passing through said loop and beneath said parallel lines, thus holding together said hoist cable from above and said endless cable form below, whereby the removal of said pin by pulling on said attached heavy cord enables the separation of said hoist cable from said endless cable, thus both said device and said suspended cargo are released from said hoist cable, upon pulling on said heavy cord, usually under emergency situations and conditions.

* * * * *